US009410733B1

(12) United States Patent
Kim

(10) Patent No.: US 9,410,733 B1
(45) Date of Patent: Aug. 9, 2016

(54) REFRIGERATOR WITH ADJUSTABLE STORAGE SPACE

(71) Applicant: Dongbu Daewoo Electronics Corporation, Seoul (KR)

(72) Inventor: Hyo Su Kim, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 14/861,253

(22) Filed: Sep. 22, 2015

(30) Foreign Application Priority Data

Jun. 17, 2015 (KR) ..... 10-2015-0086140

(51) Int. Cl.
*F25D 23/00* (2006.01)
*F25D 23/06* (2006.01)
*F25D 23/08* (2006.01)

(52) U.S. Cl.
CPC ..... *F25D 23/069* (2013.01); *F25D 23/065* (2013.01); *F25D 23/08* (2013.01); *F25D 2201/12* (2013.01)

(58) Field of Classification Search
CPC ..... F25D 23/069; F25D 23/065; F25D 23/10
USPC ..... 312/404, 406, 407, 407.1
See application file for complete search history.

(56) References Cited

U.S. PATENT DOCUMENTS

| | | | | | |
|---|---|---|---|---|---|
| 2,610,759 | A * | 9/1952 | Slade | F25D 23/069 | 220/533 |
| 2,622,412 | A * | 12/1952 | Staebler | F25D 11/022 | 62/329 |
| 3,976,122 | A * | 8/1976 | Neidhardt | A23L 3/363 | 165/265 |
| 5,501,084 | A * | 3/1996 | Chang | F25D 17/042 | 62/264 |
| 5,577,822 | A * | 11/1996 | Seon | F25D 17/065 | 312/401 |
| 5,893,620 | A * | 4/1999 | Birgelis | F25D 23/067 | 312/334.44 |
| 7,343,757 | B2 * | 3/2008 | Egan | F25D 23/02 | 312/407 |
| 2002/0050147 | A1 * | 5/2002 | Mai | F25D 3/08 | 62/457.2 |
| 2007/0228907 | A1 * | 10/2007 | Luisi | F25D 23/069 | 312/404 |

FOREIGN PATENT DOCUMENTS

| | | |
|---|---|---|
| JP | H05-340173 A | 12/1993 |
| KR | 0129496 | 11/1997 |
| KR | 10-0115735 Y1 | 12/1997 |

* cited by examiner

*Primary Examiner* — Daniel Rohrhoff

(57) ABSTRACT

An inner volume adjustment assembly using a sliding panel to adjust volumes of a refrigerating space and a freezing space of a refrigerator. The sliding panel divides a storage space into the refrigerating space and the freezing space which are respectively coupled to a refrigerating chamber and a freezer of the refrigerator. The sliding panel slides on a rail through a coupling shaft. The temperatures in refrigerating space and the freezing space can be controlled based on a detected position of the sliding panel in the storage space.

19 Claims, 11 Drawing Sheets

REFRIGERATOR WITH ADJUSTABLE STORAGE SPACE

CROSSREFERENCE

This application claims benefit of and priority to Korean Patent Application No. 10-2015-0086140, filed on Jun. 17, 2015, the entire content of which is herein incorporated by reference for all purposes.

FIELD OF THE INVENTION

Embodiments of the present invention relate to refrigerators, and, more particularly, to storage space configurations in refrigerators.

BACKGROUND OF THE INVENTION

Refrigerators are electrical appliances capable of maintaining a storage chamber below the room temperature. Food can be stored in a refrigerator in a cold or frozen state. A refrigerator may include a refrigerating compartment maintained at a temperature above zero degrees celsius and a freezing compartment (or a freezer) maintained below zero degrees.

The space inside the refrigerator is maintained at a low temperature by cool air circulation. cool air is continuously generated through a refrigeration cycle including compression, condensation, expansion and evaporation. Cool air is distributed to the inner space of the refrigerator by convection.

Typically, the main body of a refrigerator has a rectangular parallel-piped shape, with a refrigerating chamber and a freezer. A plurality of storage drawers, shelves and boxes may be provided within a storage space in the refrigerator for containing food or other items.

Generally, a top-mount style refrigerator has a freezer located at the upper portion and a refrigerating chamber located at the lower portion; while a bottom-freezer style refrigerator has a freezer located at the lower portion.

Conventionally, a partition used to separate the refrigerating chamber and the freezer from each other is formed integrally with the main body of the refrigerator. Thus, the respective volumes of the refrigerating chamber and the freezer are fixed by manufacturing and thus not adjustable regardless of the amount of food stored therein.

Korean Patent Registration No. 10-0129496 discloses a refrigerator with a freezing chamber or a refrigerating chamber of a variable volume. A diaphragm is used to as a partition to separate the freezing chamber and a refrigerating chamber from each other. The partition is movable along a separation wall. The technical disadvantages of this approach are as follows.

First, the above technique is only applicable to refrigerator products that have a freezer located at the upper portion and a refrigerating chamber located at the lower portion of the refrigerator.

Second, this technique requires additional components, such as a diaphragm, a partition and the like, to be added to the freezer. It also requires fixing grooves, fixing protrusions and the like to be built in the refrigerator main body. This introduces complex modifications of a refrigerator from the conventional design. Also in this configuration, it is difficult to maintain airtight nature.

Third, a user may not easily change the inner volumes of the refrigerating chamber and the freezing chamber.

SUMMARY OF THE INVENTION

It would be advantageous to provide an inner volume adjustment mechanism that can be used in a refrigerator storage chamber without introducing complex structural changes to the conventional refrigerating chamber or freezer, and a control method thereof.

It would also be advantageous to provide an inner volume adjustment mechanism which may easily fit in various types of refrigerators, for example, a top-mount style refrigerator, a bottom-freezer style refrigerator, a side-by-side style refrigerator and the like.

Embodiments of the present invention employs an inner volume adjustment mechanism on a refrigerator which allows the inner volumes of a refrigerating chamber and a freezer to be adjusted easily while maintaining both compartments airtight.

According to embodiments of the present invention, an inner volume adjustment assembly of a refrigerator includes an adjustment panel movable within a storage chamber to adjust a refrigerating volume or a freezing volume of the storage chamber. A sliding unit is coupled to a lower part of the adjustment panel to enable sliding motions of the adjustment panel. The sliding unit includes a rail fixedly mounted on an inner wall of the storage chamber and a connection shaft coupling the adjustment panel to a groove of the rail.

In one embodiment, the refrigerator further includes a refrigerating chamber and a freezer other than the storage chamber.

A sealing material may be applied to the periphery of the adjustment panel, where the sealing material includes silicone for example.

A heat insulating material may be attached to the inner surface of the storage chamber, where the heat insulating material includes urethane for example.

The adjustment panel can slide horizontally (leftward/rightward) along the rails.

The rails may be inserted into the heat insulating material applied to the inner surface of the storage chamber.

The sliding unit may further include a flexible sealing material to seal the upper surface of the rail when the adjustment panel slides.

The flexible sealing material may be flexibly adhered to, or separated from, the rail when the adjustment panel slides in opposite directions.

The sliding unit may further include a sealing material feed unit. One end of the flexible sealing material is fixed to the sealing material feed unit and the other end of the flexible sealing material is fixed to the adjustment panel.

The sealing material feed unit is configured to wind the flexible sealing material into a circular shape or to unwind the flexible sealing material using rotational force.

In accordance with another embodiment of the present invention, a method is described for adjusting the inner volume of a refrigerator including: sliding an adjustment panel on a rail, the adjustment panel is configured to separate a refrigerating space and a freezing space from each other; and adhering a flexible sealing material to, or separating the flexible sealing material from, the rail when the adjustment panel slides in opposite directions.

The method further includes adjusting the amount of cool air supplied to the refrigerating chamber or the freezer so that, as the refrigerating volume or the freezing volume is varied by the adjustment panel, the temperature of the refrigerating chamber or the freezer is individually adjusted.

The foregoing is a summary and thus contains, by necessity, simplifications, generalizations and omissions of detail; consequently, those skilled in the art will appreciate that the summary is illustrative only and is not intended to be in any way limiting. Other aspects, inventive features, and advantages of the present invention, as defined solely by the claims, will become apparent in the non-limiting detailed description set forth below.

BRIEF DESCRIPTION OF THE DRAWINGS

Embodiments of the present invention will be better understood from a reading of the following detailed description, taken in conjunction with the accompanying drawing figures in which like reference characters designate like elements and in which.

DETAILED DESCRIPTION OF THE INVENTION

Figure 1A:
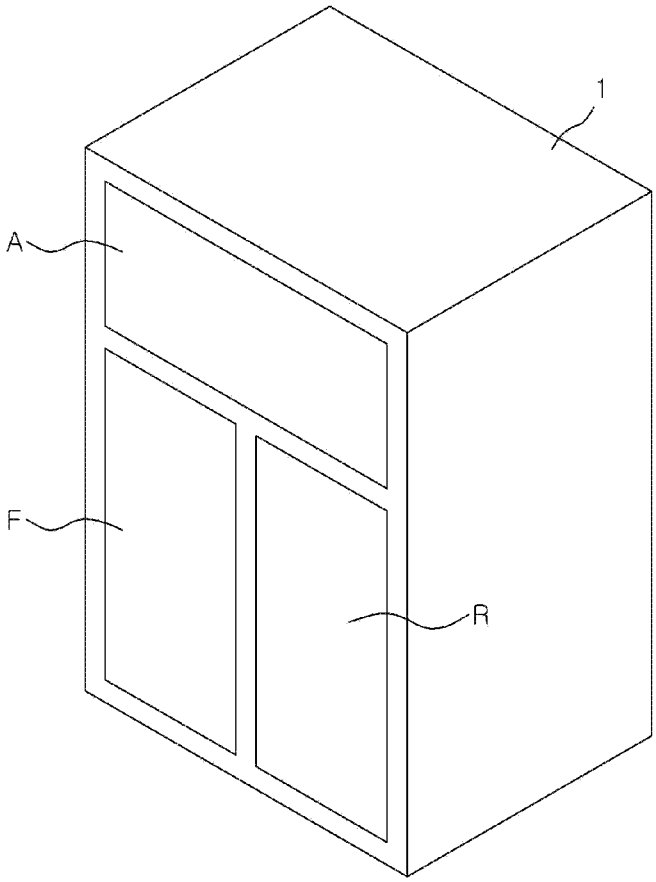
FIG. 1A is a perspective view of an exemplary refrigerator which includes an adjustable storage chamber in accordance with an embodiment of the present invention.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

Refrigerator with Adjustable Storage Space

Figure 1B:
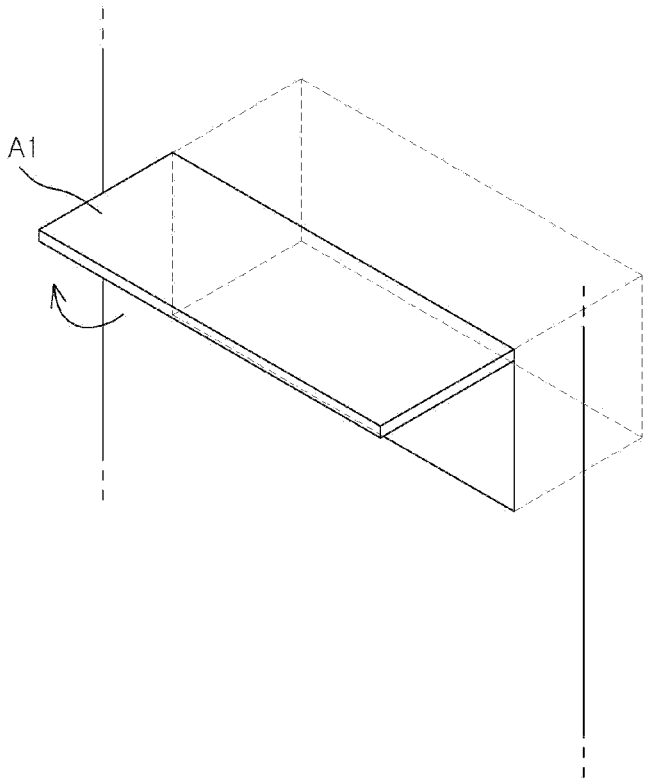
FIG. 1B is a perspective view illustrates a door of an adjustable storage chamber of FIG. 1A in an open state.

FIGS. 1A and 1B illustrate an exemplary refrigerator equipped with an exemplary adjustable storage chamber in accordance with an embodiment of the present invention.

As shown in FIG. 1A, the refrigerator may include a main body 1 forming the exterior housing of the refrigerator. A refrigerating chamber R is located on the right portion of the main body 1 for storing food. A freezer F is located on the left portion of the main body 1 for storing food and other items. According to the present disclosure, the refrigerator has an adjustable storage chamber A with adjustable volumes.

In addition, although not shown, the refrigerator further includes a divider to separate the refrigerating chamber R and the freezer F from each other and a cooling system including a compressor, a condenser, an expansion value, an evaporator and the like to generate cool air.

FIG. 1A illustrates a refrigerator with the refrigerating chamber R and the freezer F located in the lower portion of the refrigerator and the adjustable storage chamber A located in the upper portion. But the present disclosure is not limited to this arrangement.

In FIG. 1B, a rotary shaft may be located at the upper edge of the adjustable storage chamber door A1 so that the door A1 may be lifted up to open. This is especially convenient to users if the adjustable storage chamber A is disposed approximately at eye level.

Figure 2A:
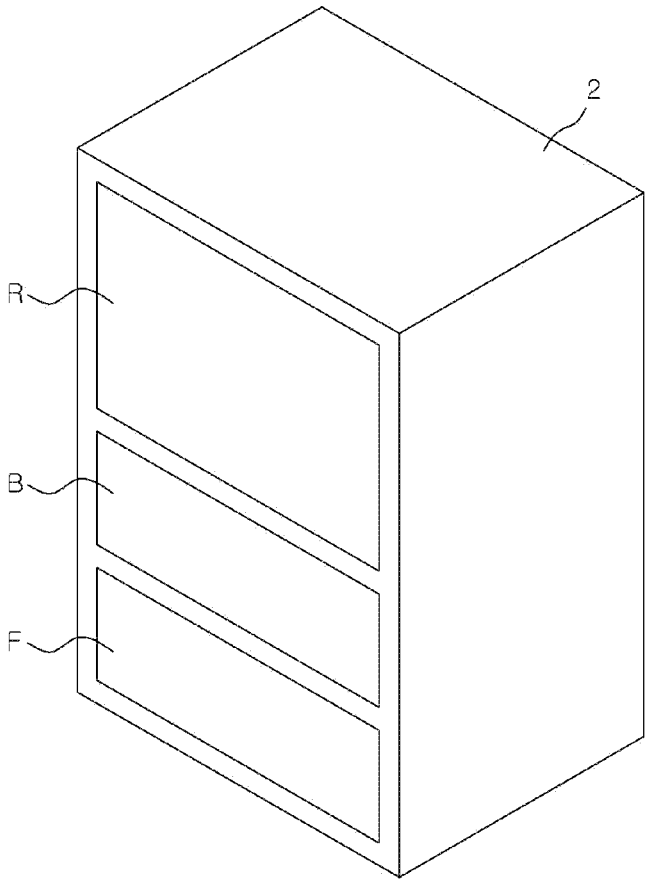
FIG. 2A is a perspective view of another exemplary refrigerator which includes an adjustable storage chamber in accordance with an embodiment of the present invention.
Figure 2B:
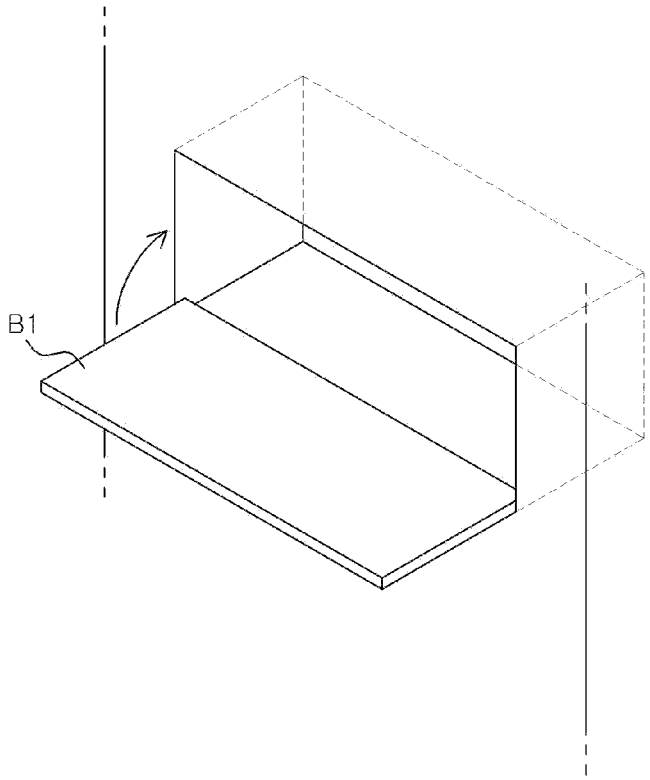
FIG. 2B is a perspective view exemplarily illustrating opening of a door of an inner volume adjustable storage chamber of FIG. 2A.

FIGS. 2A and 2B are perspective views illustrating another exemplary refrigerator including an adjustable storage chamber in accordance with one embodiment of the present invention.

In FIG. 2A, the refrigerator includes a main body 2. A refrigerating chamber R is located at the upper portion of the main body 2 for storing food. A freezer F is located at the lower portion of the main body 2. The refrigerator also includes an inner volume adjustable storage chamber B, the inner volume of which is adjustable.

In addition, although not shown, the refrigerator may further include a divider to divide the refrigerating chamber R and the freezer F from each other and a cooling system including a compressor, a condenser, an expansion value, an evaporator and the like to generate cool air in the refrigerator.

In FIG. 2A, the refrigerating chamber R is located in the upper region of the refrigerator, the freezer F is located in the lower region, and the adjustable storage chamber B in accordance with the embodiment of the present invention is in the middle.

In the example shown in FIG. 2B, a rotary shaft may be located at the lower edge of the adjustable storage chamber door B1, so that the adjustable storage chamber door B1 may be opened when rotated in a downward direction. This is especially convenient to users if the adjustable storage chamber B is disposed approximately at waist height.

Figure 3:
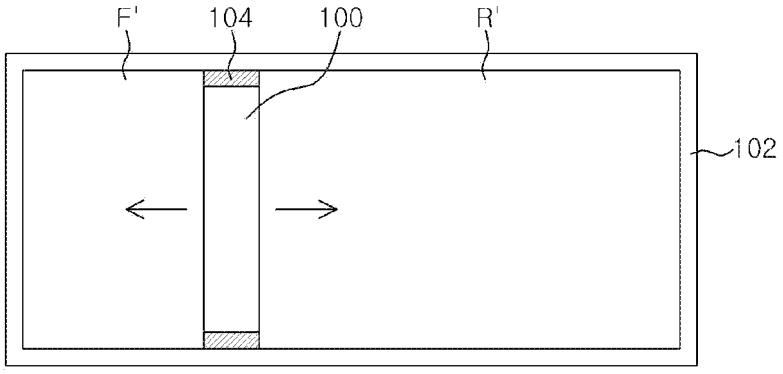
FIG. 3 is a front view of an exemplary inner volume adjustment assembly in accordance with one embodiment of the present invention.

FIG. 3 is a front view of an exemplary inner volume adjustment assembly in accordance with an embodiment of the present invention. For example, the inner volume adjustment assembly is coupled to the adjustable storage chamber A of FIG. 1A.

As shown in FIG. 3, the inner volume adjustment assembly may include an adjustment panel 100, a heat insulating material 102, and a sealing material 104.

The adjustment panel 100 is used to adjust the inner volumes of a refrigerating chamber R' and a freezer F' in the adjustable storage chamber A. The adjustment panel 100 may slide (e.g., in the leftward/rightward direction) to adjust the inner volumes of the refrigerating chamber R' and the inner volume of the freezer F'. The adjustment panel 100 may be slid manually or automatically using a driving motor.

The heat insulating material 102 fills the gap between the adjustable storage chamber A and the main body of the refrigerator and serves to enhance heat insulation for the adjustable storage chamber A. The heat insulating material 102 may be made of urethane for example.

The first sealing material 104 serves to maintain airtight seals between the adjustment panel 100 and the heat insulating material 102 and may be made of silicone for example. The first sealing material 104 may be applied to the contact region between the adjustment panel 100 and the heat insulating material 102, e.g., the periphery of the adjustment panel 100.

Figure 4:
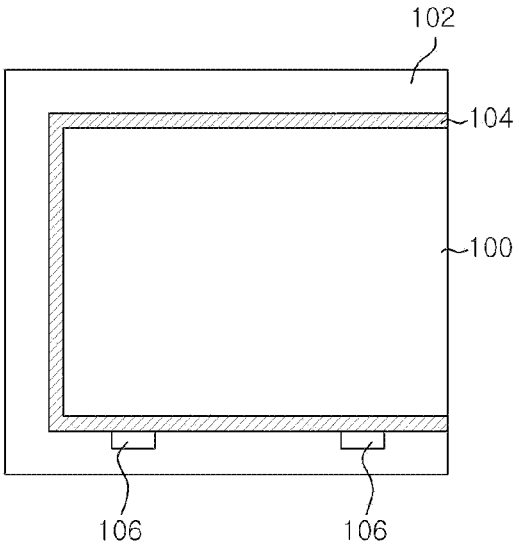
FIG. 4 is a side view of an exemplary inner volume adjustment assembly in accordance with the embodiment of the present invention.

FIG. 4 is a side view of the inner volume adjustment assembly for the inner volume adjustable storage chamber A of FIG. 3.

As shown in FIG. 4, the heat insulating material 102 may fill the gap between the adjustment panel 100 and the main body of the refrigerator. The first sealing material 104 may be applied to the adjustment panel 100 where it contacts the heat insulating material 102 during sliding motions.

That is, the adjustment panel 100 may slide horizontally to vary the inner volumes of the refrigerating chamber R' or the freezer F'. During a sliding motion, the adjustment panel 100 can maintain both heat insulation and an airtight seal of the adjustable storage chamber A.

A sliding unit 106 are used to facilitate sliding of the adjustment panel 100. For example, the sliding unit is coupled to the bottom of the adjustment panel 100.

Figure 5:
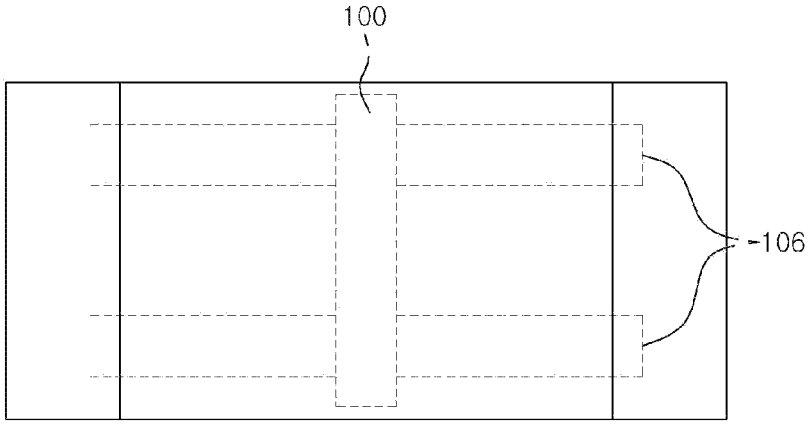
FIG. 5 is a top view of an exemplary inner volume adjustment apparatus in accordance with the embodiment of the present invention.

FIG. 5 is a top view of an exemplary adjustable storage chamber showing the adjustment panel 100 sliding by use of the sliding unit 106.

A part of the sliding unit 106 is fixedly mounted on the adjustable storage chamber A and the other part is inserted into the adjustment panel 100. Thereby, the adjustment 100 may slide across the inner volume adjustable storage chamber A.

Figure 6:
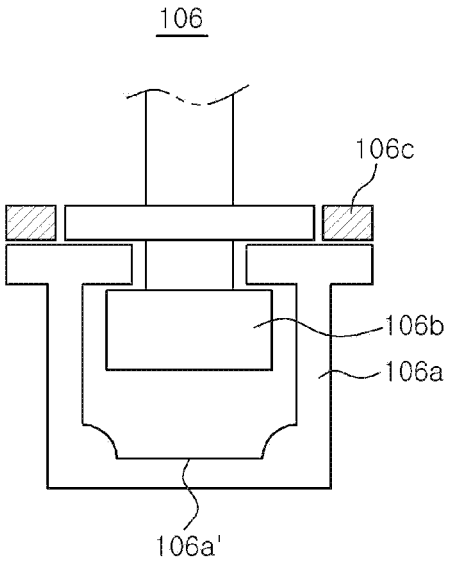
FIG. 6 illustrates the configuration of an exemplary sliding unit of FIG. 4.

FIG. 6 illustrates a configuration of an exemplary sliding unit 106 as shown in FIGS. 4 and 5 in greater detail. The sliding unit 106 may include a rail 106*a*, a coupling shaft 106*b*, and a second sealing material 106*c*.

As shown in FIG. 6, the rail 106*a* may be fixed on a bottom wall of the adjustable storage chamber, and more particularly, into the heat insulating material 102. The rail 106*a* provides a sliding path of the adjustment panel 100. A rail groove 106*a*' is formed on the rail 106*a*. As will be described in greater detail below, the coupling shaft 106*b* is coupled to the rail groove 106*a*' and can slide thereon.

Figure 8:
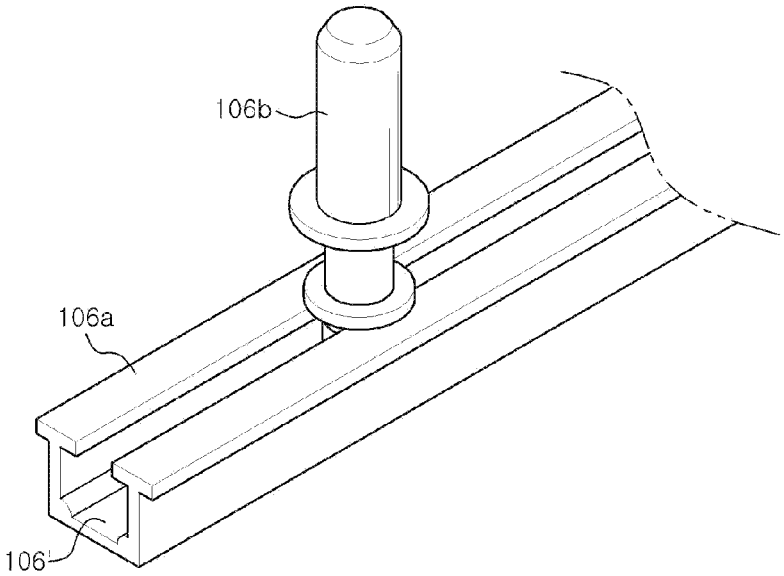
FIG. 8 is a perspective view illustrating a detailed configuration of a rail of FIG. 7.

One end of the coupling shaft 106*b* may be inserted into, and fixed to, the adjustment panel 100. The other end of the coupling shaft 106*b* may be coupled to the rail groove 106*a*' as shown in FIG. 8. In this configuration, through the coupling shaft, the adjustment panel 100 can slide along the rail 106*a*.

Figure 7:
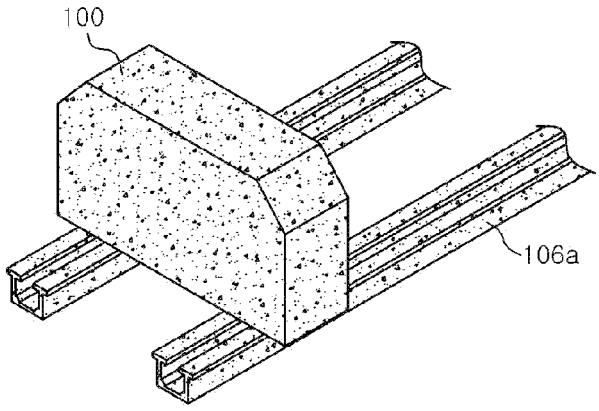
FIG. 7 is a perspective view of an adjustment panel of an exemplary inner volume adjustment assembly in accordance with the embodiment of the present invention.

FIG. 7 is a perspective view illustrating the configuration of the exemplary adjustment panel 100 and the exemplary rails 106*a*. FIG. 8 is a perspective view illustrating a detailed configuration of the rail 106*a* in FIG. 7.

Referring to FIG. 6 again, the sliding unit 106 may further include a second sealing material 106*c*.

The second sealing material 106*c* may be disposed on the upper surface of the rail 106*b* and serve to further maintain airtightness of the adjustable storage chamber A in the same manner as the first sealing material 104. Particularly, the second sealing material 106*c* aids to maintain airtightness of the adjustable storage chamber A when the adjustment panel 100 slides along the rail 106*a*.

Figure 9:
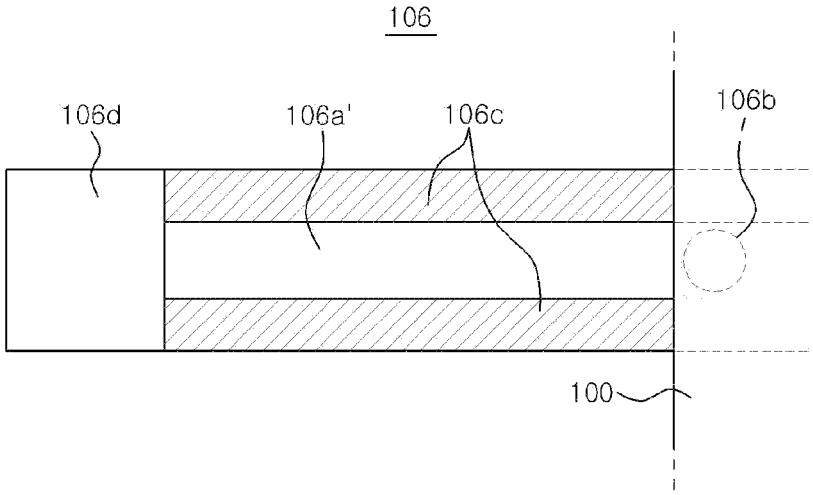
FIG. 9 is a top view of the sliding unit of FIGS. 4 and 6.
Figure 10:
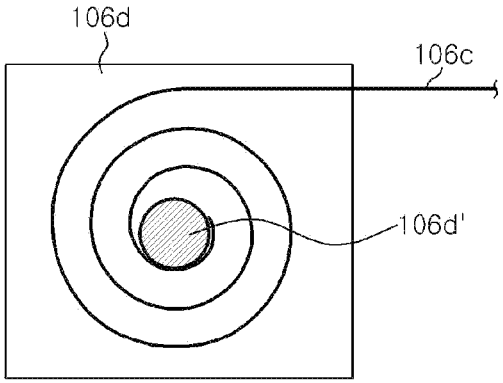
FIG. 10 illustrates the arrangement of a second sealing material in the exemplary sliding unit of FIGS. 4 and 6.

FIG. 9 is a top view of the exemplary sliding unit 106 in FIGS. 4 and 6. FIG. 10 illustrates the second sealing material 106*c* applied on the sliding unit 106 of FIGS. 4 and 6.

As shown in FIG. 9, the second sealing material 106*c* is disposed on the upper surface of the rail 106*a* and serves to maintain an airtight seal of the adjustable storage chamber A when the adjustment panel 100 slides along the rail. For example, the second sealing material 106*c* may be made of a flexible thin film.

One end of the second sealing material 106*c* may be coupled to a sealing material feed unit 106*d* and the other end of the second sealing material 106*c* may be coupled to the adjustment panel 100.

The coupling shaft 106*b* is fixedly mounted on the adjustment panel 100 and the second sealing material 106*c* is disposed on the rail 106*a* on both sides of the coupling shaft 106*b*. Therefore, the adjustment panel 100 slides along the rail 106 as the coupling shaft 106*b* moves along the rail grooves 106*a*'. During a sliding motion, the second sealing material 106*c*, the other end of which is connected to the adjustment panel 100, may adhere tightly to the rails 106*a* or be separated from the rails 106*a*.

For example, as shown in FIG. 10, the sealing material feed unit 106*d* serves to supply one end of the second flexible sealing material 106*c* to a feed shaft 106*d*'. When the adjustment panel 100 slides toward the feed unit 106*d*, and the feed unit 106*d* winds the sealing material 106*c* into a spiral shape; when the adjustment panel slides away from the feed unit 106*d*, the feed unit 106*d* unwinds (or extends) the second sealing material 106*c*. The winding and unwinding of the sealing material 106*c* are performed using the rotational force of the inner feed shaft 106*d*'.

Therefore, when the adjustment panel 100 slides back and forth, the second sealing material 106*c* is either wound on the sealing material feed unit 106*d* or unwound from the sealing material feed unit 106*d*. As a result, the second sealing material 106*c* either adheres tightly to the rails 106*c* or is lifted up from the rails 106*c*, thereby maintaining an airtight seal of the adjustable storage chamber A when the adjustment panel 100 moves.

It will be appreciated that without the second sealing material 106*c*, an air gap would be formed in the sliding unit 106 which undesirably allows external air to enter the sliding unit 106 or internal air to leak from the sliding unit 106. Thus, the second sealing material 106*c* used in the sliding unit 106 advantageously ensures an airtight seal when the adjustment panel 100 moves.

Figure 11A:
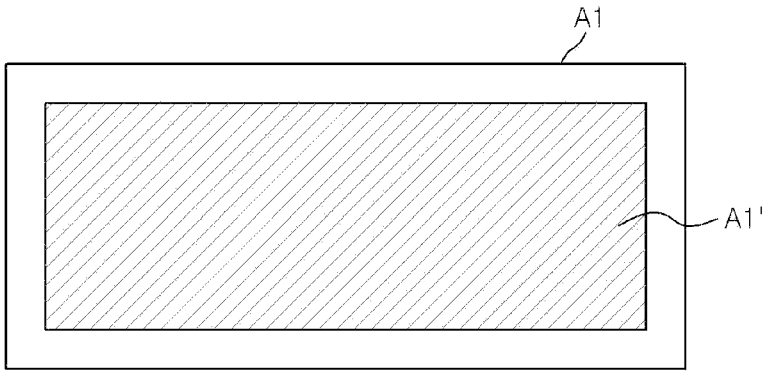
FIG. 11A illustrates the door of the exemplary adjustable storage chamber of FIG. 1A.
Figure 11B:
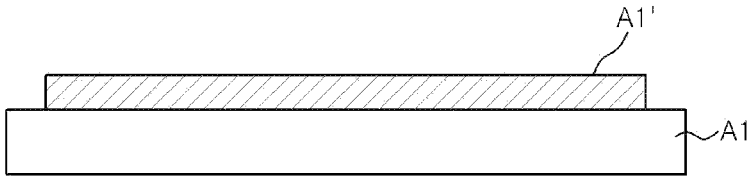
FIG. 11B is a side view of FIG. 11A.

FIG. 11A illustrates the adjustable storage chamber door A1 of FIG. 1A. FIG. 11B is a side view of FIG. 11A.

According to the present disclosure, a sealing pad A1' may be attached to the inner surface of the adjustable storage chamber door A1 to enhance heat insulation and the airtight nature of the storage chamber A.

Figure 12:
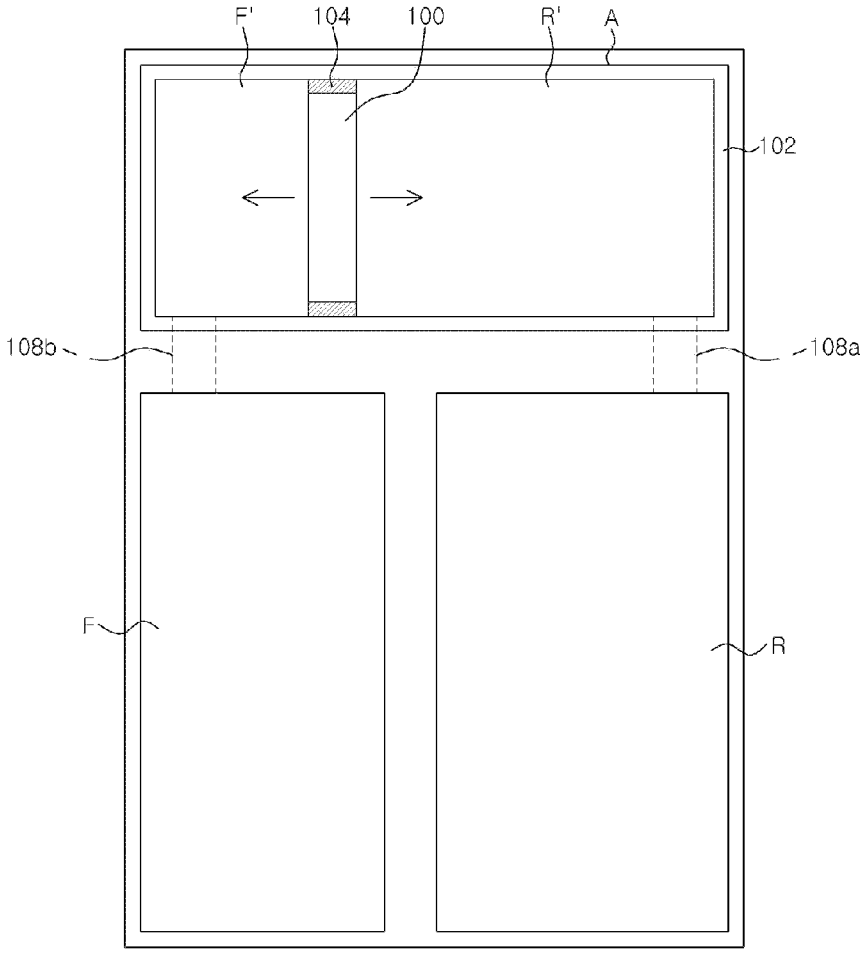
FIG. 12 is illustrates an exemplary cool air supply mechanism between the adjustable storage chamber and a refrigerating chamber/a freezer in accordance with the embodiment of the present invention.

FIG. 12 illustrates cool air flow to the adjustable storage chamber in accordance with an embodiment of the present invention.

The adjustment panel 100 is installed in the adjustable storage chamber A (see FIG. 3). The inner volume of the freezer F' and the inner volume of the refrigerating chamber R' can be adjusted by sliding the adjustment panel 100 horizontally (e.g., in the leftward/rightward direction as shown). The motion of the adjustment panel 100 may be driven by a manual force or automatically through a driving motor.

Here, the refrigerating chamber R' and the freezer F' in the adjustable storage chamber A may respectively receive cool air supplied from the refrigerating chamber R and the freezer F of the refrigerator 1 through respective cool air paths 108*a* and 108*b*. That is, cool air in the refrigerating chamber R may be supplied to the refrigerating chamber R' within the adjustable storage chamber A through the cool air path 108; and cool air in the freezer F of the refrigerator 1 may be supplied to the freezer F' within the adjustable storage chamber A through the cool air path 108*b*.

A fan (not shown) may be provided in or proximate to each of the cool air paths 108*a* and 108*b*. The amount of cool air supplied to the refrigerating chamber R' or the freezer F' can vary according to the fan speed. Thereby, the temperatures of the refrigerating chamber R' and the freezer F' can be controlled.

Sensors may be installed to determine a position of the adjustment panel 100. The sensors may be disposed around the outlets of the cool air paths 108*a* and 108*b*. The fans may be individually controlled based on the determined position of the adjustment panel 100.

Herein, a method of controlling cool air flow to adjust the temperatures of the refrigerating chamber R' and the freezer F' is described with reference to FIG. 13.

Figure 13:
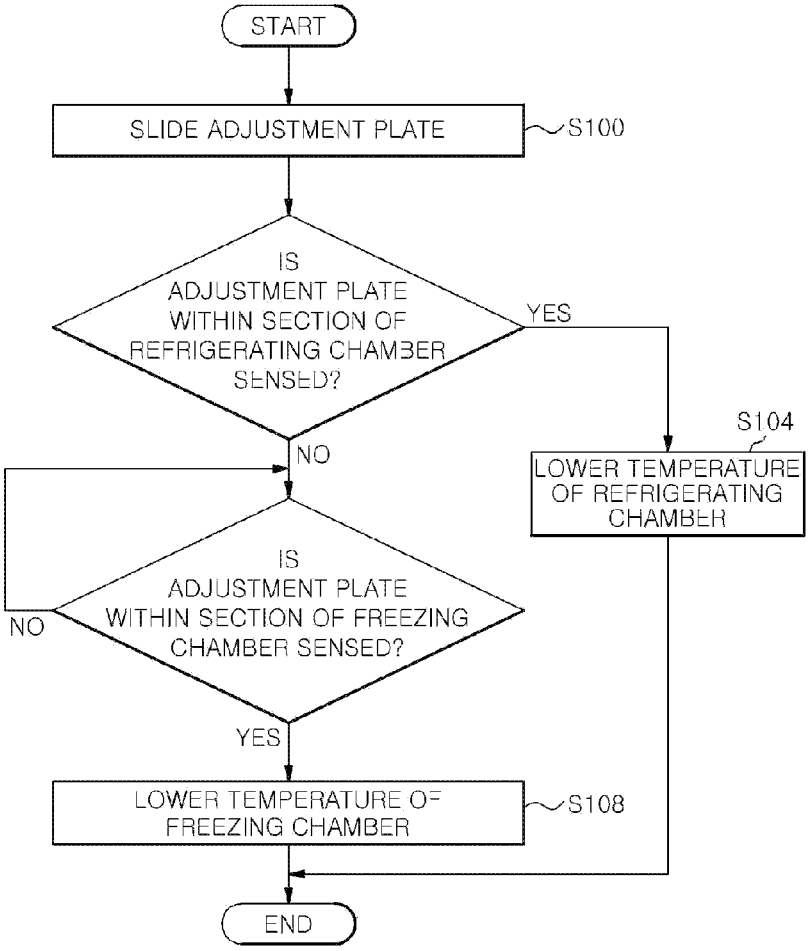
FIG. 13 is a flowchart illustrating an exemplary method for adjusting the temperature (supply of cool air) in an adjustable storage chamber in accordance with one embodiment of the present invention.

As shown in FIG. 13, when the adjustment panel 100 slides (at S100), the sensors installed in the inner storage chamber A are used to determine the position of the adjustment panel 100. The sensing results can detect if the adjustment panel 100 is within the section of the refrigerating chamber R' or within the section of the freezer F'.

If the sensor installed proximate to the outlet of the cool air path 108*a* to the refrigerating chamber R' senses the presence of the adjustment panel 100 (at S102), the speed (e.g., in the unit of revolution per minute (RPM)) of the fan in the cool air path 108*a* may be adjusted to maintain the temperature of the refrigerating chamber R' (at S104). For example, sensing of the adjustment panel 100 by the sensor installed around the outlet of the cool air path 108*a* indicates that the volume of the refrigerating chamber R' is decreased. Accordingly, the speed of the fan is decreased so that the amount of cool air supplied from the refrigerating chamber R is reduced.

On the other hand, if the sensor installed around the outlet of the cool air path 108*b* to the freezer F' senses the presence of the adjustment panel 100 (at S106), the speed of the fan for the cool air path 108*b* may be adjusted to maintain the temperature of the freezer F' (Operation S108). For example, sensing of the adjustment panel 100 by the sensor located proximate to the outlet of the cool air path 108*b* means that the inner volume of the freezer F' is decreased. Accordingly, the speed of the fan is decreased to such that that the amount of cool air supplied from the freezer F is reduced to maintain the freezer F' at a desired temperature.

Therefore, an inner volume adjustment assembly of a refrigerator in accordance with embodiments of the present invention may easily vary the inner volumes of a refrigerating space and a freezing space without losing the airtight nature of the compartments. The adjustment assembly can be applied in conventional types of refrigerators to achieve an adjustable storage chamber while requiring no complex product design change. For example, a volume adjustment assembly according to the present disclosure can be used in a top-mount style refrigerator, a bottom-freezer style refrigerator, a side-by-side style refrigerator and the like.

Further, the inner volume adjustment assembly in accordance with embodiments of the present invention may dynamically and individually control cool air supply based on the respective inner volumes of the refrigerating chamber and the freezer within the adjustable storage chamber. Thus the temperatures therein can be constantly maintained.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A volume adjustment assembly of a refrigerator, the volume adjustment assembly comprising:

an adjustment panel configured to: separate a storage chamber of the refrigerator into a refrigerating space and a freezing space; and slide within the storage chamber to adjust volumes of the refrigerating space and the freezing space; and a sliding unit coupled to the adjustment panel and operable to enable the adjustment panel to slide, wherein the sliding unit comprises:

a rail mounted in the storage chamber; and a coupling shaft configured to couple the adjustment panel to the rail, wherein the coupling shaft is operable to move along the rail.

2. The volume adjustment assembly according to claim 1, wherein refrigerator comprises a refrigerating chamber and a freezer aside from the storage chamber, wherein the refrigerating space is exposed to the refrigerating chamber through a cool air flow path, and wherein further the freezing space is exposed to the refrigerating chamber through another cool air flow path.

3. The volume adjustment assembly according to claim 1 further comprising a sealing material applied to a periphery of the adjustment panel.

4. The volume adjustment assembly according to claim 3, wherein the sealing material comprises silicone.

5. The volume adjustment assembly according to claim 1, wherein the storage chamber comprises a heat insulating material disposed on an inner surface of the storage chamber.

6. The volume adjustment assembly according to claim 5, wherein the heat insulating material comprises urethane.

7. The volume adjustment assembly according to claim 6, wherein the rail is inserted into the heat insulating material on the inner surface of the storage chamber.

8. The volume adjustment assembly according to claim 1, wherein the adjustment panel is operable to slide horizontally along the rail.

9. The volume adjustment assembly according to claim 1, wherein the sliding unit further comprises a flexible sealing material disposed on an upper surface of the rail and operable to maintain an airtight seal when the adjustment panel slides.

10. The volume adjustment assembly according to claim 9, wherein the flexible sealing material is: operable to adhere to the rail when the adjustment panel moves in a first direction;

and operable to separate from the rail when the adjustment panel slides in a second direction, opposite to the first direction.

11. The volume adjustment assembly according to claim 9, wherein the sliding unit further comprises a sealing material feed unit, and wherein one end of the flexible sealing material is fixed to the sealing material feed unit and another end of the flexible sealing material is fixed to the adjustment panel.

12. The volume adjustment assembly according to claim 11, wherein the sealing material feed unit is configured to use rotational forces to: wind the flexible sealing material when the adjustment panel slides in the first direction; and unwind the flexible sealing material when the adjustment panel slides in the second direction.

13. A method for adjusting a storage space in a refrigerator, the method comprising:

sliding an adjustment panel in a first direction within the storage space to increase a refrigerating space and decrease a freezing space in the storage space, wherein the adjustment panel separates the refrigerating space and the freezing space from each other; and sliding the adjustment panel in a second direction opposite to the first direction within the storage space to increase the freezing space and decrease the refrigerating space in the storage space.

14. The method according to claim 13, wherein the slidings comprise sliding the adjustment panel on a rail mounted in the storage space, and further comprising adhering a flexible sealing material to the rail when the adjustment panel slides in the first direction; and lifting the flexible sealing material from the rail when the adjustment panel slides in the second direction.

15. The method according to claim 14, further comprising:

determining a position of the adjustment panel with reference to the storage space; and individually controlling cool air flows to the refrigerating space and the freezing space based on the position of the adjustment panel.

16. A refrigerator comprising:

an adjustable storage chamber;

an adjustment panel disposed in the adjustable storage chamber and configured: to separate the adjustable storage chamber of the refrigerator into a refrigerating space and a freezing space; and slide within the adjustable storage chamber to adjust volumes of the refrigerating space and the freezing space; and a sliding rail mounted in the adjustable storage chamber and coupled to the adjustment panel; and a coupling shaft configured to couple the adjustment panel on to the sliding rail, wherein the coupling shaft is operable to move along the sliding rail.

17. The refrigerator according to claim 16, further comprising a refrigerating chamber and a freezer aside from the storage chamber, wherein the refrigerating space is exposed to the refrigerating chamber through a first cool air flow path, and wherein the freezing space is exposed to the freezer through a second cool air flow path.

18. The refrigerator according to claim 17, further comprising fans configured to drive cool air flow from the refrigerating chamber to the refrigerating space and cause cool air to flow from the freezer to the freezing space.

19. The refrigerator according to claim 16, further comprising a motor configured to drive the adjustment panel to slide along the sliding rail.

* * * * *